US010273564B2

(12) United States Patent
Kumar M et al.

(10) Patent No.: US 10,273,564 B2
(45) Date of Patent: Apr. 30, 2019

(54) ALUMINIUM BASED ALLOYS FOR HIGH TEMPERATURE APPLICATIONS AND METHOD OF PRODUCING SUCH ALLOYS

(71) Applicant: Indian Institute of Science, Bangalore (IN)

(72) Inventors: Surendra Kumar M, Bangalore (IN); Sukla Mondol, Bangalore (IN); Subodh Kumar, Bangalore (IN); Satyam Suwas, Bangalore (IN); K. Chattopadhyay, Bangalore (IN)

(73) Assignee: INDIAN INSTITUTE OF SCIENCE, Bangalore (IN)

( * ) Notice: Subject to any disclaimer, the term of this patent is extended or adjusted under 35 U.S.C. 154(b) by 243 days.

(21) Appl. No.: 15/118,670

(22) PCT Filed: Dec. 26, 2014

(86) PCT No.: PCT/IB2014/067341
§ 371 (c)(1),
(2) Date: Aug. 12, 2016

(87) PCT Pub. No.: WO2015/121723
PCT Pub. Date: Aug. 20, 2015

(65) Prior Publication Data

US 2017/0051383 A1 Feb. 23, 2017

(30) Foreign Application Priority Data

Feb. 14, 2014 (IN) ..... 715/CHE/2014

(51) Int. Cl.
*B22D 15/00* (2006.01)
*B22D 21/00* (2006.01)
(Continued)

(52) U.S. Cl.
CPC ..... *C22C 21/14* (2013.01); *B22D 15/00* (2013.01); *B22D 21/007* (2013.01); *C22C 21/12* (2013.01); *C22F 1/057* (2013.01)

(58) Field of Classification Search
CPC ..... C22C 21/12; C22C 21/14; B22D 15/00; B22D 21/007; C22F 1/057
See application file for complete search history.

(56) References Cited

U.S. PATENT DOCUMENTS 4,618,382 A * 10/1986 Miyagi ..... C22F 1/053 148/415
5,759,302 A 6/1998 Nakai et al.
(Continued)

FOREIGN PATENT DOCUMENTS

WO 2002063059 8/2002
WO 2008003503 1/2008
WO WO 2008/003503 * 1/2008

OTHER PUBLICATIONS

International Search Report and Written Opinion of International application PCT/IB/2014/067341, dated Apr. 8, 2015, total 12 pages.

*Primary Examiner* — C Melissa Koslow
(74) *Attorney, Agent, or Firm* — Hamre, Schumann, Mueller & Larson, P.C.

(57) ABSTRACT

The present disclosure relates to aluminum based alloys and a method for producing the aluminum based alloys. The method comprises acts of, casting of the aluminum based alloy in a chilled casting mold. Then, aging the cast aluminum based alloy at a first predetermined temperature for a first predetermined time. The aging results in the formation of a first precipitate. Followed by this, solutionizing the aluminum based alloy at a second predetermined temperature for a second predetermined time such that the major alloying element is dissolved in aluminum matrix without
(Continued)

much affecting the first precipitate. Then, aging the aluminum based alloy at a third predetermined temperature for a third predetermined time. The aging results in the formation of a second precipitate.

9 Claims, 8 Drawing Sheets

(51) Int. Cl.

| | |
|---|---|
| ***C22C 21/12*** | (2006.01) |
| ***C22C 21/14*** | (2006.01) |
| ***C22F 1/057*** | (2006.01) |

(56) References Cited

U.S. PATENT DOCUMENTS

| | | | |
|---|---|---|---|
| 6,074,498 | A | 6/2000 | Waldron et al. |
| 6,248,453 | B1 | 6/2001 | Watson |

* cited by examiner

Al-4.6Cu-0.33Nb-0.49Zr
TEM Dark Field image

ALUMINIUM BASED ALLOYS FOR HIGH TEMPERATURE APPLICATIONS AND METHOD OF PRODUCING SUCH ALLOYS

TECHNICAL FIELD

The present disclosure relates to a field of metallurgy. Particularly, the disclosure relates to the aluminum based alloys and a method of producing such aluminum based alloys.

BACKGROUND

In modern applications such as aerospace applications, cylinder head manufactures, engines etc., large integral aluminium alloy structural components are widely used. The main requirement of such aluminum alloys is that their properties should be good at high temperatures ranging from about 200° C. to 300° C. as well as at room temperature.

Aluminium alloys of 2XXX series with high strength at room temperature are commercially available and are extensively used in aerospace applications. For example, alloys such as 2034 are used for fuselage skin, bulk heads wing lower skin, stringers and panels as well as in ribs and spars. Another commercially available alloy is 2024 that is widely used for high strength and high toughness applications. These alloys have yield strength of about 395 MPa with 10% elongation at room temperature, but are not suitable for high temperature applications.

Among aluminium alloys, 2219 alloy possesses high strength at elevated temperature. Major applications of this alloy are in aerospace industries. However, the application of this alloy is also restricted to a maximum temperature of 150° C., above which, the strengthening precipitates coarsen rapidly resulting in steep loss in strength. This alloy in T8 temper has yield strength of about 355 MPa with 9.4% elongation at room temperature, while at 250° C., it is about 159 MPa with 21% elongation. Therefore, aluminium alloys with good strength at temperatures above 150° C. pose a challenge.

Heat treatment plays a crucial role in tuning mechanical and physical properties of aluminium alloys. Conventionally, these alloys are processed through solution heat treatment, quenching followed by aging (natural or artificial). Additionally, cold working is also occasionally introduced prior to aging. The solution treatment is done to dissolve the alloying elements into solid solution of the matrix. After this treatment, the aluminium alloy is quenched to room temperature to retain the alloying elements in aluminium solid solution termed as supersaturated solid solution. This alloy is then heated to intermediate temperature and held (aging) so that the supersaturated solid solution is decomposed to form finely dispersed precipitates in aluminium matrix. The decomposition of the solid solution involves the formation of Guinier-Preston (GP) zones and metastable intermediate precipitates. The GP zones are solute rich clusters of atoms and are coherent with the matrix. Metastable intermediate precipitates are normally larger in size than GP zones and are partly or fully coherent with the lattice planes of the matrix. This phase may form homogenously or may nucleate heterogeneously on GP zones or lattice defects such as dislocations. Mechanical deformation prior to aging increases dislocation density and provides more sites where heterogeneous nucleation of intermediate precipitates may occur. The strengthening of the alloy occurs due to the presence of these precipitates by several mechanisms which have been reported in the literature.

The heat treatment temperatures depend on the alloy system. For example, for 2XXX series alloys the solutionizing temperature is between 530° C.-540° C. and aging temperature is between 130° C.-200° C. For 7XXX series alloys, the solutionizing temperature is between 450° C.-470° C. and the aging temperature is 120° C.-135° C. For some alloys, duplex aging (two stage aging) is carried out. For example, 7075 alloy is processed through duplex aging in which the first stage at low temperature (121° C.) involves precipitation of GP zones and in the second stage at slightly higher temperature (171° C.) metastable intermediate η' precipitates form. In this case, $1^{st}$ stage gives pronounced hardening while $2^{nd}$ stage results in a significant improvement in stress corrosion cracking.

U.S. Pat. No. 6,074,498 discloses Al—Cu—Li—Sc alloys produced by duplex aging. After solutionizing and quenching, the alloy is aged between 120° C.-140° C. for 8 to 30 hrs followed by aging at temperatures between 150° C.-170° C. The final microstructure contains metastable θ' ($Al_2Cu$) and δ' ($Al_3Li$) precipitates throughout the aluminium matrix. This alloy gives good room temperature strength but at temperatures above 150° C., these precipitates coarsen rapidly resulting in low strength.

In recent past, for improving high temperature (>200° C.) stability of aluminium alloys, transition metals (TM) such as Sc, Zr, Ti, Hf etc. have been added in small amounts. These elements form trialuminides ($Al_3TM$) with aluminium at Al-rich portion of the phase diagram. Most of them have $DO_{22}$ or $DO_{23}$ equilibrium structure but they can also form metastable $L1_2$ structure, which is coherent and uniformly distributed in the aluminium matrix. These dispersions have high melting points and are stable at high temperature up-to 300° C. due to very low diffusivity of these transition metals in aluminium. These alloying elements often have very low solubility in aluminium and hence in order to achieve higher super saturation in aluminium a high cooling rate during solidification from the liquid melt is often required. After super saturation, these can be aged at intermediate temperature between 300° C.-400° C. so that it will decompose to yield nanometric coherent $L1_2$ type precipitates in aluminium matrix. In normal casting route, high super saturation cannot be achieved. Several investigators reported decomposition of chill cast Al-TM alloys to $L1_2$ $Al_3TM$ coherent dispersions in aluminium matrix. Their room temperature strengths are relatively low as compared to the existing aluminium alloys. However, their stability at high temperatures is better than the existing aluminium alloys.

U.S. Pat. No. 6,248,453 discloses Al alloys with improved strength up to 300° C. by dispersion of fine $L1_2$ intermetallics $Al_3X$, where X is Sc, Er, Lu, Yb, Tm or U. Since the dispersion of these fine intermetallic particles necessitated high cooling rates ($10^4$-$10^8$ K/s), it was achieved by employing rapid solidification techniques, such as, gas atomization and melt spinning. Such rapid solidification techniques generally produce powder, fibres or ribbons, which necessitated consolidation.

In light of foregoing discussion, it is desirable to produce an aluminium alloy with higher strength at both room temperatures as well as at high temperatures, and a method of producing such aluminum alloy by casting, rather than rapid solidification techniques, to overcome the limitations stated above.

SUMMARY OF THE DISCLOSURE

The shortcomings of the prior art are overcome and additional advantages are provided through the provision of method and product as claimed in the present disclosure.

Additional features and advantages are realized through the techniques of the present disclosure. Other embodiments and aspects of the disclosure are described in detail herein and are considered a part of the claimed disclosure.

In one non limiting embodiment of the present disclosure, a method for producing an aluminium based alloy is provided. The method comprises of, casting an aluminium based alloy in a chilled casting mould. Then, aging the cast aluminium based alloy at first predetermined temperature for a first predetermined time. The aging results in the formation of a first precipitate. Followed by this, solutionizing the aluminium based alloy at second predetermined temperature for a second predetermined time such that the major alloying element is dissolved in aluminium matrix without much affecting the first precipitate. Then, aging the aluminium alloy at a third predetermined temperature for a third predetermined time. The aging results in the formation of a second precipitate. The first predetermined temperature is higher than the third predetermined temperature.

In an embodiment of the present disclosure, the method may or may not comprise of cold working of the aluminium alloy between casting and aging.

In an embodiment of the present disclosure, the method comprises of fast cooling of the aluminium based alloy after aging and solutionizing. The fast cooling is done by, but not limiting to, quenching in water bath.

In an embodiment of the present disclosure, the casting mould is chilled copper mould.

In an embodiment of the present disclosure, the first predetermined temperature ranges from 350° C. to 450° C., and the first predetermined time ranges from 5 hours to 40 hours. The second predetermined temperature ranges from 525° C. to 545° C., and the second predetermined time ranges from 15 minutes to 60 minutes. The third predetermined temperature ranges from 150° C. to 250° C., and the third predetermined time ranges from 2 hours to 30 hours.

In an embodiment of the present disclosure, the alloying elements, along with incidental elements, of the alloy are melted by arc melting for casting the aluminium alloy.

In an embodiment of the present disclosure, alloying elements are selected from a group comprising Aluminium (Al), Copper (Cu), Zirconium (Zr), Niobium (Nb), Hafnium (Hf), Vanadium (V), and combinations thereof. Further, the incidental elements are selected from a group comprising Titanium, Chromium, Manganese, Iron, Silicon, and combinations thereof.

In another non limiting embodiment of the present disclosure, there is provided an aluminium based alloy produced by a method as explained in previous paragraphs. The alloy comprises Copper (Cu) at 4 wt % to 6.5 wt %, Zirconium (Zr) at 0.3 wt % to 0.5 wt %, at least one transition metal selected from a group comprising Niobium (Nb) at 0.3 wt % to 0.5 wt %, Hafnium (Hf) at 0.3 wt % to 0.6 wt %; and Vanadium (V) at 0.18 wt % to 0.36 wt %. The balance being aluminium (Al) along with incidental elements.

In an embodiment of the present disclosure, the incidental elements are selected from a group comprising Titanium, Chromium, Manganese, Iron, Silicon, and combinations thereof.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE ACCOMPANYING FIGURES

The novel features and characteristics of the disclosure are explained herein. The embodiments of the disclosure itself, however, as well as a preferred mode of use, further objectives and advantages thereof, will best be understood by reference to the following detailed description of an illustrative embodiment when read in conjunction with the accompanying drawings. One or more embodiments are now described, by way of example only, with reference to the accompanying drawing in which.

Figure 1:
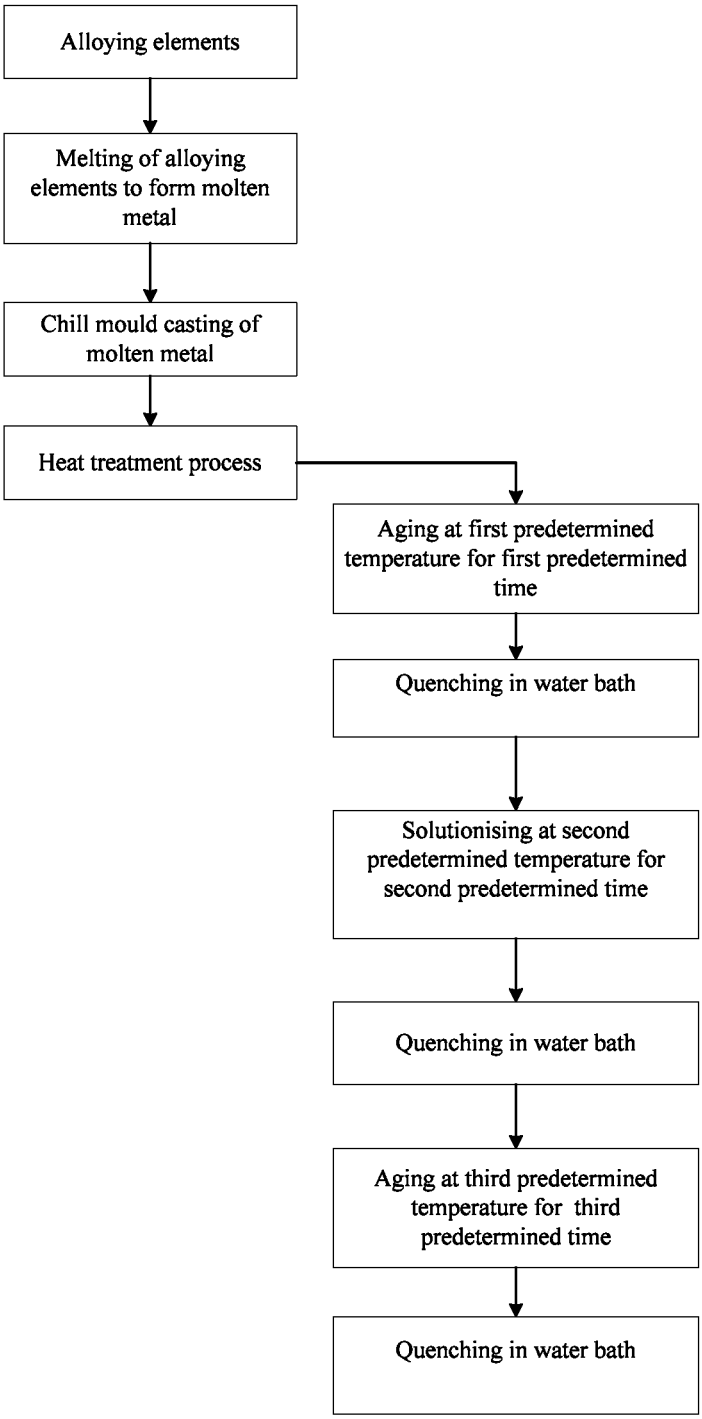
FIG. 1 illustrates a flow chart of a method of producing an aluminum based alloy of the present disclosure.

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION

The foregoing has broadly outlined the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

To overcome the drawbacks mentioned in the background, the present disclosure provides a new class of aluminium alloys together with a method of producing such aluminium alloys. The aluminum alloy of the present disclosure, gives high strength at room temperature as well at high temperature ranging from 200° C. to 300° C. The class of aluminium alloys developed contains alloying additions like Zirconium (Zr), Niobium (Nb), Vanadium (V), Hafnium (Hf) or similar elements singly or in combination together with alloying additions that give high strength due to precipitation hardening like Aluminium (Al)-Copper (Cu) alloys of 2XXX series or other aluminium based alloys having similar alloying for precipitation strengthening. The alloy optionally contains incidental elements selected from a group comprising but not limiting to Titanium, Chromium, Manganese, Iron, Silicon, and combination thereof.

The aluminum alloys are produced by casting in chill mould or similar processes that yield similar cooling rates. Then, the cast alloys are subjected to three stage heat treatment process, which results in both the low temperature precipitation and high temperature precipitation. The high temperature precipitates are stable at elevated temperatures and also reduce the coarsening of low temperature strengthening precipitates on exposure at elevated temperatures up to 300° C.

FIG. 1 is an exemplary embodiment of the present disclosure which illustrates a flow chart of method of producing aluminium based alloy. The method comprises following acts, firstly preparing the molten metal of alloying elements optionally along with incidental elements of the aluminium based alloy. In an embodiment of the present disclosure, the alloying elements are melted by arc melting, however any similar melting process can be adapted to melt the alloying elements. In an embodiment, the alloying elements are selected from a group comprising Aluminium (Al), Copper (Cu), Zirconium (Zr), Niobium (Nb), Hafnium (Hf), Vanadium (V) and combination thereof. Further, the incidental elements are selected from a group comprising Titanium, Chromium, Manganese, Iron, Silicon, and combination thereof. The molten metal is then poured into the chilled cast mould for casting the aluminium based alloy. In an embodiment of the present disclosure, the chilled cast mould is water cooled copper mould, or any similar processes that yield similar cooling rates can be used for casting the aluminium based alloy. Further, a cold working may optionally be introduced onto the aluminium based alloy after casting the alloy, and before subjecting it to heat treatment process. In an embodiment of the present disclosure, the cold working process is selected from a group comprising but not limiting to rolling, extrusion, drawing and forging.

The cast aluminium alloy is subjected to three stage heat treatment process to get a fine distribution of two precipitates, the first one at high temperature and the second one at low temperature. The three stage heat treatment process comprises of the following steps. Firstly, aging directly at first predetermined temperature ranging from 350° C. to 450° C. for a first predetermined time ranging from 5 hours to 40 hours. This first stage of heat treatment process, results in the formation of the first precipitate in the matrix, i.e., $L1_2$ type $Al_3X$ (where X is transition metal). Then, the aluminium alloy is subjected to a fast cooling. Further, the aluminium alloy is subjected to second stage of heat treatment process, i.e., solutionizing treatment at second predetermined temperature ranging from 525° C. to 545° C. for a second predetermined time ranging from 15 minutes to 60 minutes. The solutionizing treatment on the aluminium alloy completely dissolves the elements which are responsible for low temperature precipitation like copper without affecting the high temperature precipitates. This is achieved by controlling the time and temperature for solutionizing. After solutionizing treatment, the aluminium alloy is subjected to a fast cooling. The third step of heat treatment is aging at the third predetermined temperature ranging from 150° C. to 250° C. for third predetermined time ranging from 2 hours to 30 hours. This third stage of heat treatment process results in the formation of the second precipitate in the matrix, i.e., low temperature strengthening θ' precipitates. The high temperature $Al_3X$ precipitates reduce the coarsening of low temperature strengthening θ' precipitates. Then, the aluminium alloy is subjected to a fast cooling. In an embodiment of the present disclosure, the fast cooling of the aluminium based alloy after each stage of the heat treatment process is done by at least one of quenching in water bath or any fast cooling technique which is known in the art.

In an embodiment of the present disclosure, a new class of aluminium alloy is disclosed. The aluminium alloy of the present disclosure, gives high strength at room temperature as well at high temperature ranging from 200° C. to 300° C. The class of aluminium alloy being developed contains alloying elements such as Copper (Cu) at 4 wt % to 6.5 wt %, Zirconium (Zr) at 0.3 wt % to 0.5 wt %. At least one or combination of transition metals is added to the alloy to increase the strength. The transition metals are selected from a group comprising, Niobium (Nb) at 0.3 wt % to 0.5 wt %, Hafnium (Hf) at 0.3 wt % to 0.6 wt %, Vanadium (V) at 0.18 wt % to 0.36 wt %. The balance being aluminium (Al) optionally along with incidental elements. In an embodiment of the present disclosure, the incidental elements are selected from a group comprising but not limiting to Titanium, Chromium, Manganese, Iron, Silicon, and combination thereof.

The aluminium based alloy as disclosed above would have tensile properties as following: 0.2% proof stress of 460 MPa, ultimate tensile strength of 540 MPa, and elongation to fracture of 6%, at room temperature; and 0.2% proof stress of 250 MPa, ultimate tensile strength of 260 MPa and elongation to fracture of 8.5%, at high temperature 250° C. Further, the Vickers hardness of aluminium based alloy as disclosed above would range about 1400 MPa-1520 MPa at room temperature.

Example

The aluminium alloy is produced by using the method as disclosed in the present disclosure. The quaternary aluminium alloy containing copper, niobium, zirconium is made with composition Al-4.6Cu-0.33Nb-0.49Zr (wt % everywhere). The mechanical properties of this alloy are compared with a binary Al-4.6Cu alloy in peak aged condition. The quaternary alloy is prepared by arc melting process followed by remelting and casting into 3 mm rods using water cooled copper mould. After casting, this alloy is heat treated, i.e., subjected to aging at 400° C. for 10 hours, then quenched in water. This process results in the formation of $L1_2$ type $Al_3(Zr,Nb)$ precipitates (first precipitates) with no effect on copper. Then it is subjected to solution heat treatment at 535° C. for 30 minutes so that copper dissolves into the aluminium matrix and is quenched in water to retain copper in solid solution. This treatment does not have significant effect on $Al_3$(Zr,Nb) precipitates. Finally, an aging treatment is carried out at 190° C. for 5 hours till the peak hardness is reached. The final microstructure contains nanometric θ" (second precipitates) and $Al_3$(Zr,Nb) precipitates.

Figure 2:
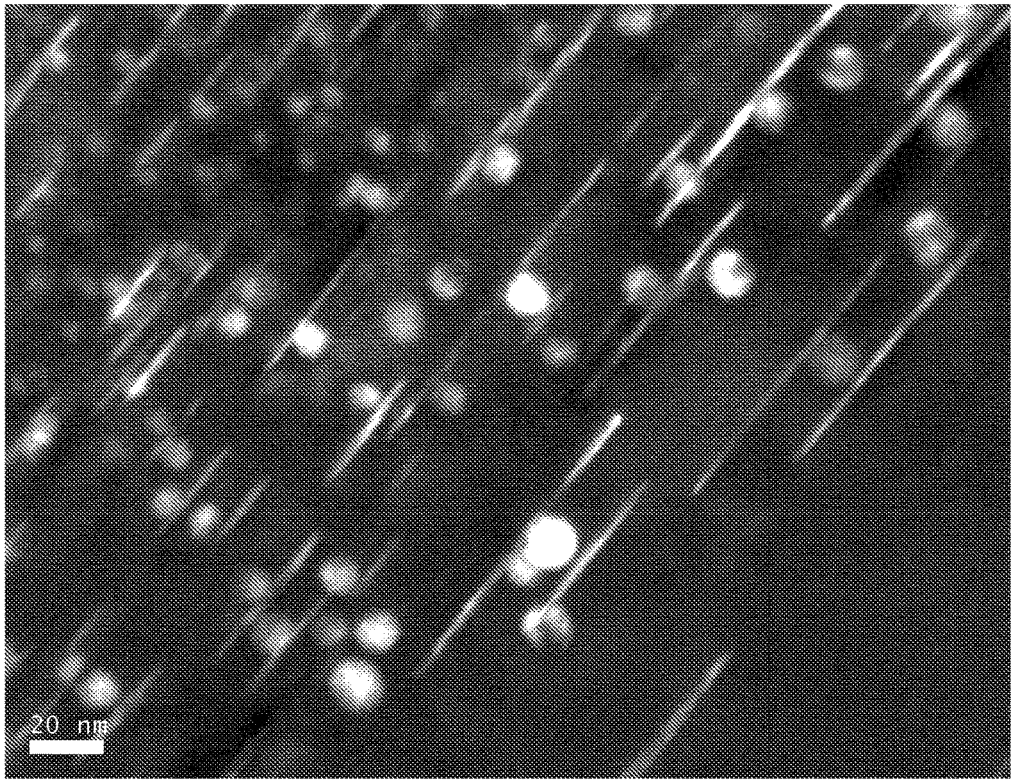
FIG. 2 illustrates Transmission Electron Microscope (TEM) Dark Field image of the quaternary Al-4.6Cu-0.33Nb-0.49Zr (wt % everywhere) alloy showing plate shaped θ' ($Al_2Cu$) precipitates with spherical $Al_3$(Zr,Nb) precipitates in the final microstructure.
Figure 3:
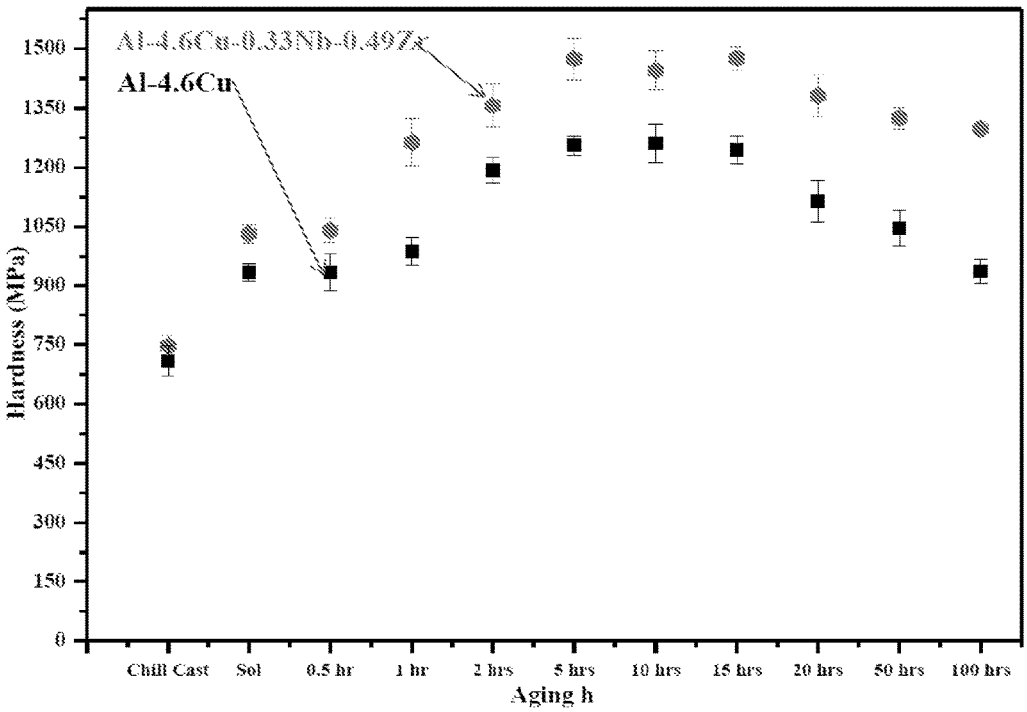
FIG. 3 illustrates aging curve at third predetermined temperature 190° C. for quaternary Al-4.6Cu-0.33Nb-0.49Zr alloy, which is produced by the method of present disclosure, and binary Al-4.6Cu alloy produced by conventional heat treatment.
Figure 4:
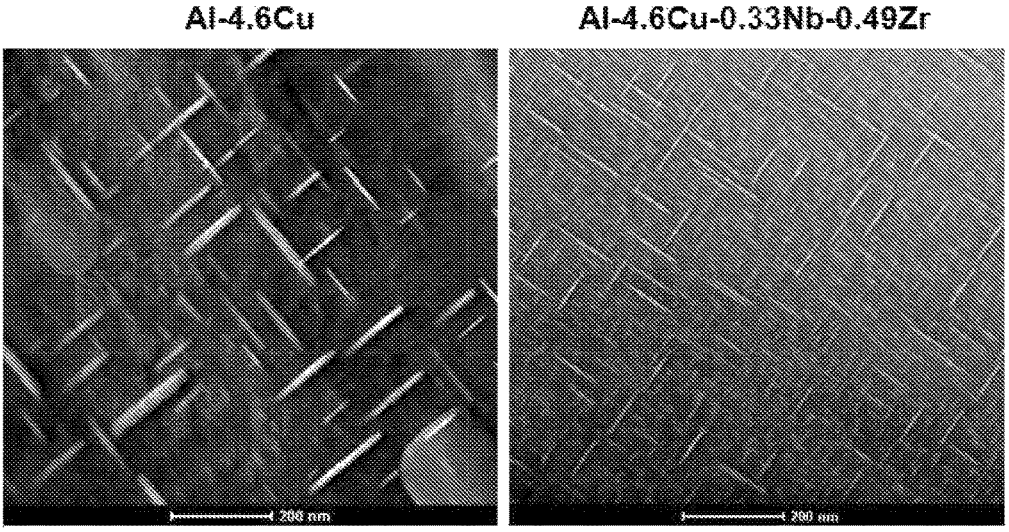
FIG. 4 illustrates Scanning Transmission Electron Microscope (STEM) HAADF micrographs of binary Al-4.6Cu and quaternary Al-4.6Cu-0.33Nb-0.49Zr alloys peak aged at 190° C.
Figure 5:
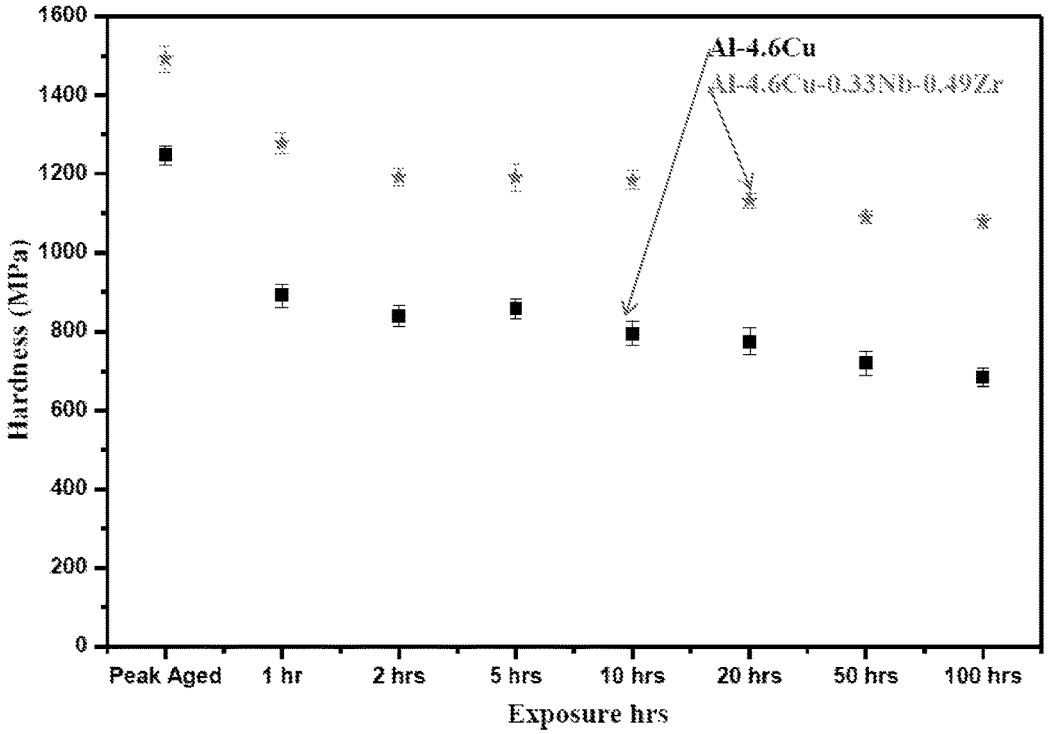
FIG. 5 illustrates stability curves of peak aged (at 190° C.) binary Al-4.6Cu and quaternary Al-4.6Cu-0.33Nb-0.49Zr alloys at 250° C.
Figure 6:
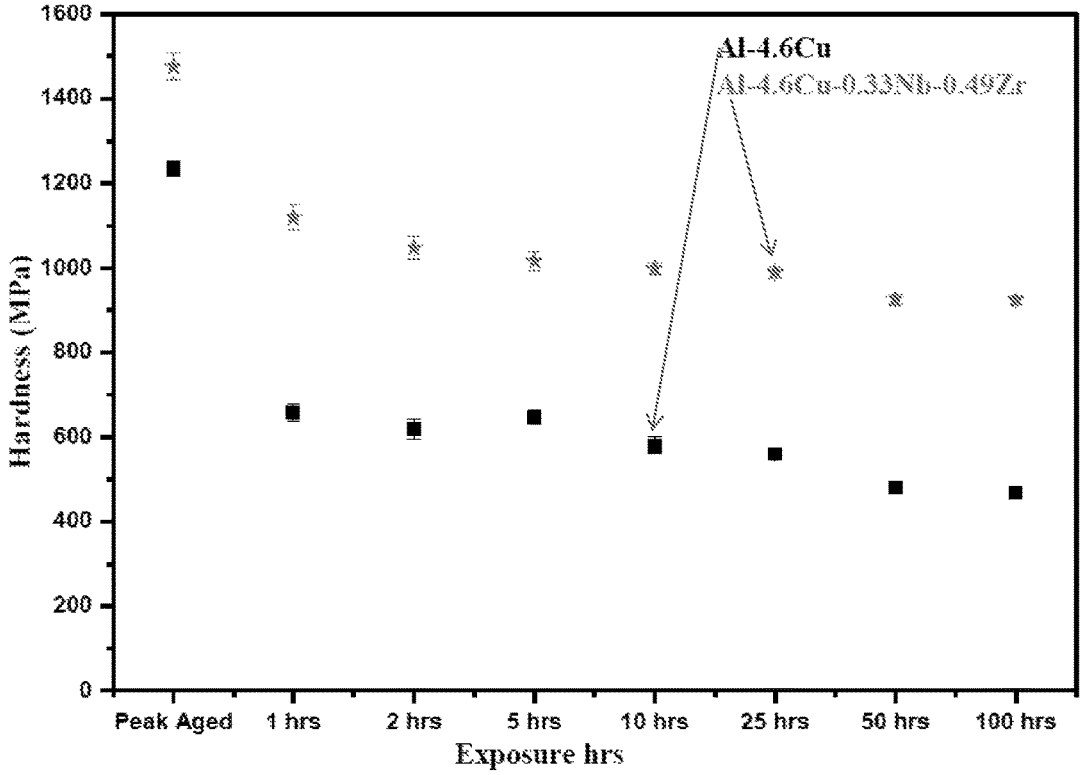
FIG. 6 illustrates stability curves of peak aged (at 190° C.) binary Al-4.6Cu and quaternary Al-4.6Cu-0.33Nb-0.49Zr alloys at 300° C.
Figure 7:
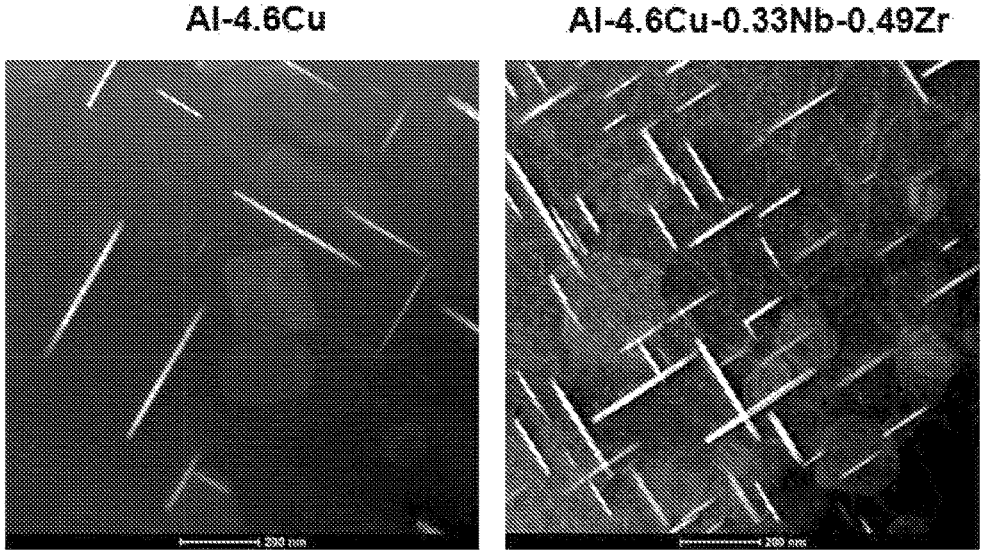
FIG. 7 illustrates Scanning Transmission Electron Microscope (STEM) HAADF micrographs of peak aged (at 190° C.) binary Al-4.6Cu and quaternary Al-4.6Cu-0.33Nb-0.49Zr alloys after 50 hours exposure at 250° C.

The final TEM microstructure shows the presence of plate shaped θ" precipitates along with spherical $Al_3$(Zr,Nb) precipitates in FIG. 2. FIG. 3 shows aging curve at 190° C. for Al-4.6Cu alloy after conventional heat treatment and for Al-4.6Cu-0.33Nb-0.49Zr alloy after the three stage heat treatment described in the present disclosure. The peak aged hardness value for the quaternary alloy is obtained as 1475 MPa after 5 hours of aging, which is much higher than the peak hardness value of 1261 MPa obtained for the binary alloy after 10 hours of aging. FIG. 4 shows comparison of microstructure for both Al-4.6Cu and Al-4.6Cu-0.33Nb-0.49Zr alloys peak aged at 190° C., and it is clear that the size and distribution of θ' precipitates in quaternary alloy is much finer than θ' precipitates in the binary alloy. From FIGS. 5 and 6, it is observed that the room temperature hardness values after exposure at 250° C. and 300° C. up to 100 hours are much higher for the Al-4.6Cu-0.33Nb-0.49Zr alloy (peak aged at 190° C.) than the Al-4.6Cu alloy (peak aged at 190° C.). FIG. 7 shows microstructure of Al-4.6Cu and Al-4.6Cu-0.33Nb-0.49Zr alloys (peak aged at 190° C.) after exposure of 50 hours at 250° C. It is clear that the coarsening of θ' precipitates is markedly less in the quaternary alloy as compared to the coarsening of θ' precipitates in binary alloy.

Figure 8:
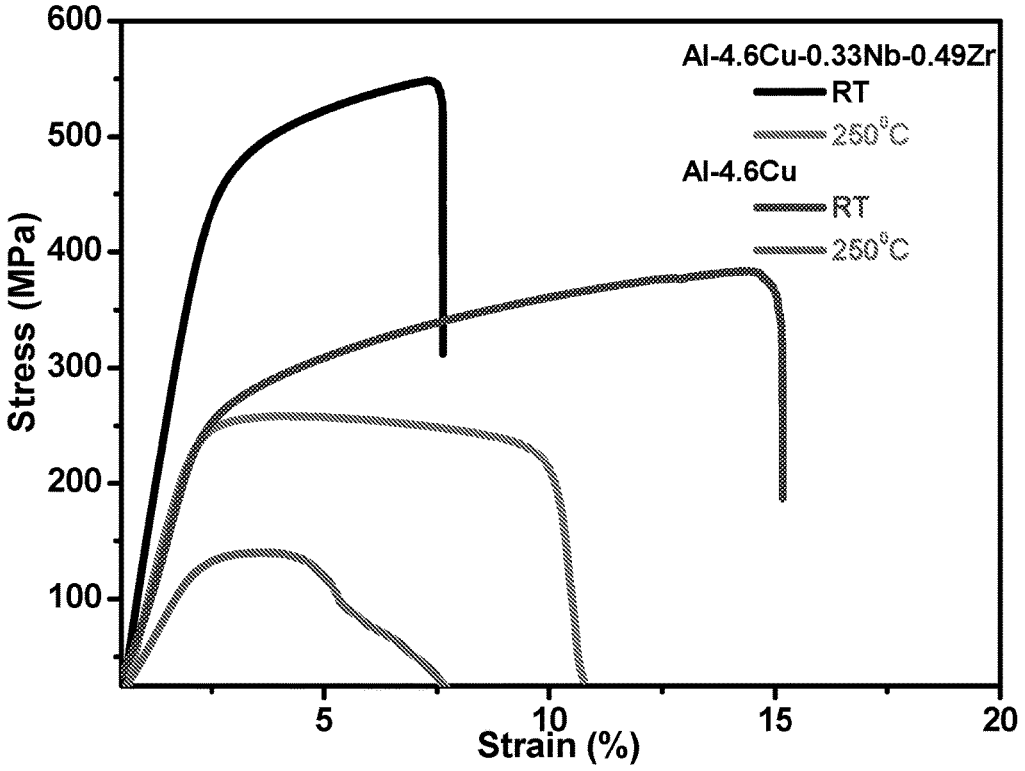
FIG. 8 illustrates tensile test curves of binary Al-4.6Cu and quaternary Al-4.6Cu-0.33Nb-0.49Zr alloy (peak aged at 190° C.) at room temperature and at 250° C.

The tensile specimens were tested using Zwick screw driven tensile testing machine at a strain rate of $10^{-3}$/sec. For high temperature testing, the samples were kept in electric furnace attached to machine and temperature was raised to 250° C. at a rate of 10° C./min. After reaching the temperature, it was held for 30 minutes in order to stabilize the temperature. FIG. 8 shows tensile test curves for both Al-4.6Cu and Al-4.6Cu-0.33Nb-0.49Zr alloys (peak aged at 190° C.) at room temperature and at 250° C. In peak aged condition, the quaternary alloy shows 0.2% proof stress of 460 MPa, ultimate tensile strength of 540 MPa and 6% elongation at room temperature. The binary alloy shows 0.2% proof stress of 250 MPa, ultimate tensile strength of 275 MPa and 12.5% elongation at room temperature. At 250° C., the quaternary alloy shows 0.2% proof stress of 250 MPa, ultimate tensile strength of 260 MPa and 8.5% elongation. On the other hand, the binary alloy shows 0.2% proof stress of 125 MPa, ultimate tensile strength of 135 MPa and 5.5% elongation at 250° C. Thus, the strength values of the quaternary alloy are much higher than the binary alloy at room temperature and at 250° C.

As another example, the aluminium based alloy containing Copper, Hafnium, Zirconium is made with composition of Al-4.6Cu-0.63Hf-0.49Zr by the method of the present disclosure. The aluminium based alloy of this composition, after final aging at 190° C. for 5 hours (peak aged), has hardness value of 1496 MPa at room temperature.

As yet another example, the aluminium based alloy containing Copper, Vanadium, Zirconium is made with composition of Al-4.6Cu-0.27V-0.49Zr by the method of the present disclosure. The aluminium based alloy of this composition, after final aging at 190° C. for 20 hours (peak aged), has hardness value of 1426 MPa at room temperature.

Further, the aluminium based alloy containing Copper, Niobium, and Zirconium and other incidental elements in which 0.33 wt % Nb and 0.34 wt % Zr are added to 2219 Al alloy (Al-6.5Cu-0.32Mn-0.13Zr-0.06V-0.03Ti-0.05Si-0.13Fe) is produced by the method of the present disclosure. The aluminium based alloy of this composition, after final aging at 190° C. for 5 hours (peak aged), has hardness of 1515 MPa.

Table 1 summarizes the peak aged hardness values at 190° C. for Al-4.6Cu and commercial 2219 aluminium alloys after conventional heat treatment, and the peak aged hardness values at 190° C. for Al-4.6Cu-0.33Nb-0.49Zr, 2219-0.33Nb-0.34Zr, Al-4.6Cu-0.63Hf-0.49Z, and Al-4.6Cu-0.27V-0.49Zr alloys after the three stage heat treatment described in the present disclosure.

TABLE 1

| Heat Treatment | Alloys | Peak Aged hardness (MPa) at 190° C. |
|---|---|---|
| Conventional | Al—4.6Cu | 1261 |
| | 2219 | 1425 |
| Three Stage | Al—4.6Cu—0.33Nb—0.49Zr | 1475 |
| Heat Treatment | 2219-0.33Nb—0.34Zr | 1515 |
| Schedule | Al—4.6Cu—0.63Hf—0.49Zr | 1496 |
| | Al—4.6Cu—0.27V—0.49Zr | 1426 |

It is to be noted that 0.2% proof stress value is expected to be about one-third of the hardness value reported in MPa.

With respect to the use of substantially any plural and/or singular terms herein, those having skill in the art can translate from the plural to the singular and/or from the singular to the plural as is appropriate to the context and/or application. The various singular/plural permutations may be expressly set forth herein for the sake of clarity.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A method for producing an aluminium based alloy comprising:

a. casting of the aluminium based alloy in a chilled casting mould, the aluminium based alloy including a composition in weight percentage of: copper (Cu) at 4 wt % to 6.5 wt %; Zirconium (Zr) at 0.3 wt % to 0.5 wt %; and at least one transition metal selected from a group including: (a) Niobium (Nb) at 0.3 wt % to 0.5 wt %; (b) Hafnium (Hf) at 0.3 wt % to 0.6 wt %; and (c) Vanadium (V) at 0.18 wt % to 0.36 wt %; wherein the balance being aluminium (Al) and optionally along with incidental elements of the alloy;

b. aging the cast aluminium based alloy at a first predetermined temperature for a first predetermined time, wherein the aging results in the formation of first precipitate;

c. solutionising the aluminium based alloy at a second predetermined temperature for a second predetermined time; and d. aging the aluminium based alloy at a third predetermined temperature for a third predetermined time, wherein the aging results in the formation of second precipitate;

wherein, the first predetermined temperature is higher than the third predetermined temperature.

2. The method as claimed in claim 1 optionally comprise an act of cold working of the aluminium based alloy between acts a and b.

3. The method as claimed in claim 1 comprises an act of fast cooling of the aluminium based alloy by quenching in water bath after acts b, c and d.

4. The method as claimed in claim 1, wherein the casting mould is chilled copper mould.

5. The method as claimed in claim 1, wherein the first predetermined temperature ranges from 350° C. to 450° C., and the first predetermined time ranges from 5 hours to 40 hours.

6. The method as claimed in claim 1, wherein the second predetermined temperature ranges from 525° C. to 545° C., and the second predetermined time ranges from 15 minutes to 60 minutes.

7. The method as claimed in claim 1, wherein the third predetermined temperature ranges from 150° C. to 250° C., and the third predetermined time ranges from 2 hours to 30 hours.

8. The method as claimed in claim 1, wherein alloying elements are melted by arc melting for casting the ingot of the aluminium based alloy.

9. The method as claimed in claim 1, wherein the incidental elements are selected from a group comprising Titanium, Chromium, Manganese, Iron, Silicon, and combination thereof.

* * * * *